United States Patent [19]

Spazierer et al.

[11] Patent Number: 4,916,269

[45] Date of Patent: Apr. 10, 1990

[54] PUSH-BUTTON ROCKER ELECTRIC SWITCH

[75] Inventors: Hubert Spazierer; Adam Weber, both of Bietigheim-Bissingen, Fed. Rep. of Germany

[73] Assignee: SWF Auto-Electric GmbH, Bietigheim-Bissingen, Fed. Rep. of Germany

[21] Appl. No.: 223,966

[22] Filed: Jul. 25, 1988

[30] Foreign Application Priority Data

Jul. 25, 1987 [DE] Fed. Rep. of Germany ..... 3724736

[51] Int. Cl.[4] ..... H01H 5/14; H01H 5/08

[52] U.S. Cl. ..... 200/408; 200/437; 200/438; 200/529

[58] Field of Search ..... 200/408, 409, 424, 425, 200/426, 427, 429, 430, 431, 434, 435, 436, 437, 438, 439, 445, 453, 459, 460, 461, 529; 74/100 R, 100 D

[56] References Cited

U.S. PATENT DOCUMENTS

| | | | |
|---|---|---|---|
| 1,883,786 | 10/1932 | Hanser et al. | 200/453 |
| 2,044,065 | 6/1936 | Douglas | 200/437 X |
| 2,047,950 | 7/1936 | Douglas | 200/437 |
| 2,076,073 | 4/1937 | Douglas | 200/438 X |
| 2,095,179 | 10/1937 | Douglas | 200/430 |
| 2,095,180 | 10/1937 | Douglas | 200/437 |
| 2,695,524 | 11/1954 | Eaton | 200/408 |
| 2,697,364 | 12/1954 | Koch | 200/408 X |
| 2,881,292 | 4/1959 | Winter et al. | 200/529 X |
| 2,994,750 | 4/1961 | Raab | 200/425 |
| 3,046,377 | 7/1962 | Fraser . | |
| 3,051,810 | 8/1962 | Wahlstrom | 200/461 X |
| 3,233,058 | 2/1966 | Horst | 200/431 |
| 3,521,013 | 7/1970 | Baumanis | 200/461 |
| 3,593,235 | 7/1971 | Nicol . | |
| 4,357,511 | 11/1982 | Tenner et al. | 200/431 X |
| 4,757,164 | 7/1988 | Bauer et al. | 200/453 |

FOREIGN PATENT DOCUMENTS

| | | | |
|---|---|---|---|
| 0112483 | 7/1984 | European Pat. Off. . | |
| 0232765 | 8/1987 | European Pat. Off. . | |
| 1098073 | 1/1961 | Fed. Rep. of Germany . | |
| 3151501 | 7/1983 | Fed. Rep. of Germany . | |
| 3625548 | 2/1988 | Fed. Rep. of Germany . | |
| 1219295 | 5/1960 | France | 200/409 |

*Primary Examiner*—Ernest G. Cusick
*Attorney, Agent, or Firm*—Robert P. Seitter

[57] ABSTRACT

An electric switch having a housing including a base plate, the switch comprising a push-button which is preferably movable in a linear direction with respect to the housing, a switching tappet movable by the push-button and swivellable relative to the switching tappet and a switching rocker rotatably mounted on the base plate, the rocker being swivellable to and fro in turns between two end positions via the push-button and the switching tappet and controlling a movable bridging contact, especially a snap-action spring.

6 Claims, 2 Drawing Sheets

PUSH-BUTTON ROCKER ELECTRIC SWITCH

BACKGROUND OF THE INVENTION

The invention relates to an electric switch used especially adapted for use in motor vehicles.

A similar electric switch is known, for example, from German specification DE-OS 31 51 501. Apart from a frame, the housing of the known electric switch comprises a base plate onto which several components can be mounted before the housing is assembled and the push-button is inserted. Thus, in the known switch, the base plate is provided with stationary contacts and corresponding outside connections formed as blade terminals and with the switching rocker rotatably mounted thereon. Furthermore, a movable bridging contact and a pressure spring loading said bridging contact are likewise mounted on the base plate.

In the known switch, a switching tappet which is part of the switching mechanism is pushed against a swivelling bearing on the push-button by two pressure springs. Thus, the tappet is swivellably mounted on the push-button. Since the swivelling bearing is moved together with the push-button, when the push-button is moved, the switching tappet is movable in the housing together with the push-button.

In the known switch, the switching mechanism can only be checked with respect to the cooperation of its essential parts (i.e., the bridging contact. switching rocker and switching tappet) when the switch is completely assembled that means when the push-button is inserted. In such case, it is rather difficult to remove any occurring failure. This is especially disadvantageous with very sensitive switching mechanisms, especially snap-action switching systems in which the switching rocker controls a snap-action spring.

SUMMARY OF THE INVENTION

An object of the present invention is to provide an electric switch having a switching mechanism which can be checked at a very early stage of the assembly so that possible mistakes can easily be corrected.

According to the invention this object is achieved with respect to an electric switch by mounting the switching tappet on the base plate. Thus, the swivelling bearing of the switching tappet is no longer on the push-button, but it is positioned on the base plate and is in the same part in which the switching rocker is also mounted. Thus, after providing the base plate; the stationary contacts, the bridging contact, the switching rocker and the switching tappet can be checked to assure that they cooperate properly. Possible mistakes can easily be corrected.

In a preferred embodiment, the swivelling axis is stationary with respect to the switching tappet, while the switching tappet is swivelled around. This construction assures that the reference between the push-button and the swivelling axis of the switching tappet is absolutely clear.

Th movability and the swivellability of the switching tappet is achieved in a simple way by mounting the tappet by means of at least one pivot pin and at least one elongated hole. If the elongated hole is in the base plate and the pivot pin is on the switching tappet, the swivelling axis is stationary regarding the switching tappet.

It is a further advantage that the tappet is held on the base plate so that it cannot be lost. Thus, it is much easier to examine the assembly and its functioning. The fact that the tappet cannot be lost is achieved in a simple assembly by, preferably, providing the elongated hole with an inserting slot comprising an inserting inclination, which slot is smaller than the diameter of the pivot pin.

It is also advantageous to provide an electric switch wherein the switching tappet is always arranged in a rest position relative to the switching rocker so that the switching tappet need be moved only minimally in order to switch over the switching rocker. Therefore, a relatively small elongated hole is sufficient for mounting the switching tappet so that the assembly does not take much space.

In order to further save space, centering springs can be provided for the switching tappet which act upon each pivot pin of the switching tappet projecting into an elongated hole. This feature can also be provided by means of a long spring, if the base plate is provided with a bore that extends in the prolongation of the elongated hole and that is open toward the elongated hole.

BRIEF DESCRIPTION OF THE DRAWING

An embodiment of an electric switch according to the invention is illustrated in the drawings wherein.

DETAILED DESCRIPTION OF A PREFERRED EMBODIMENT

Figure 1:
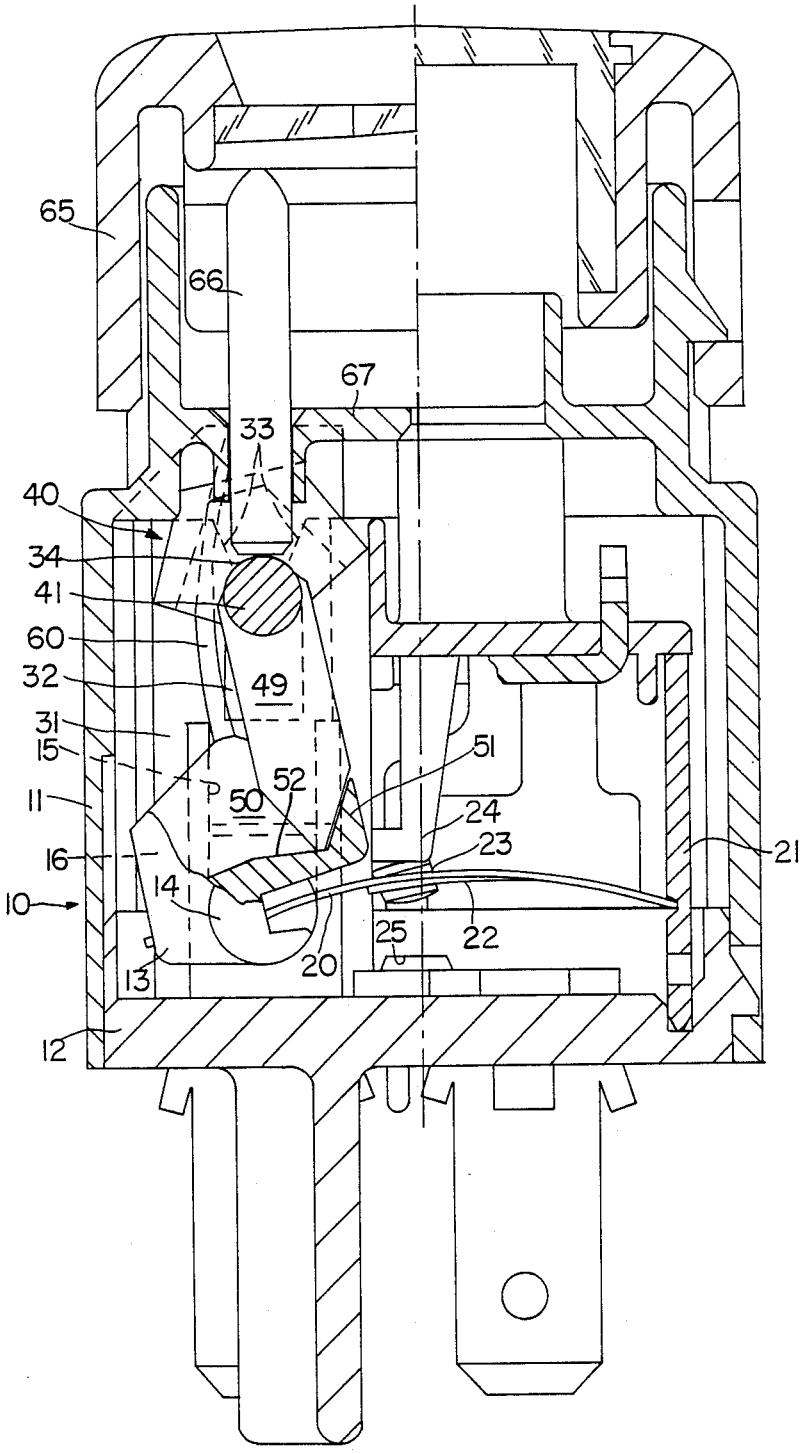
FIG. 1 is a partial sectional view of an electric switch of this invention.
Figure 2:
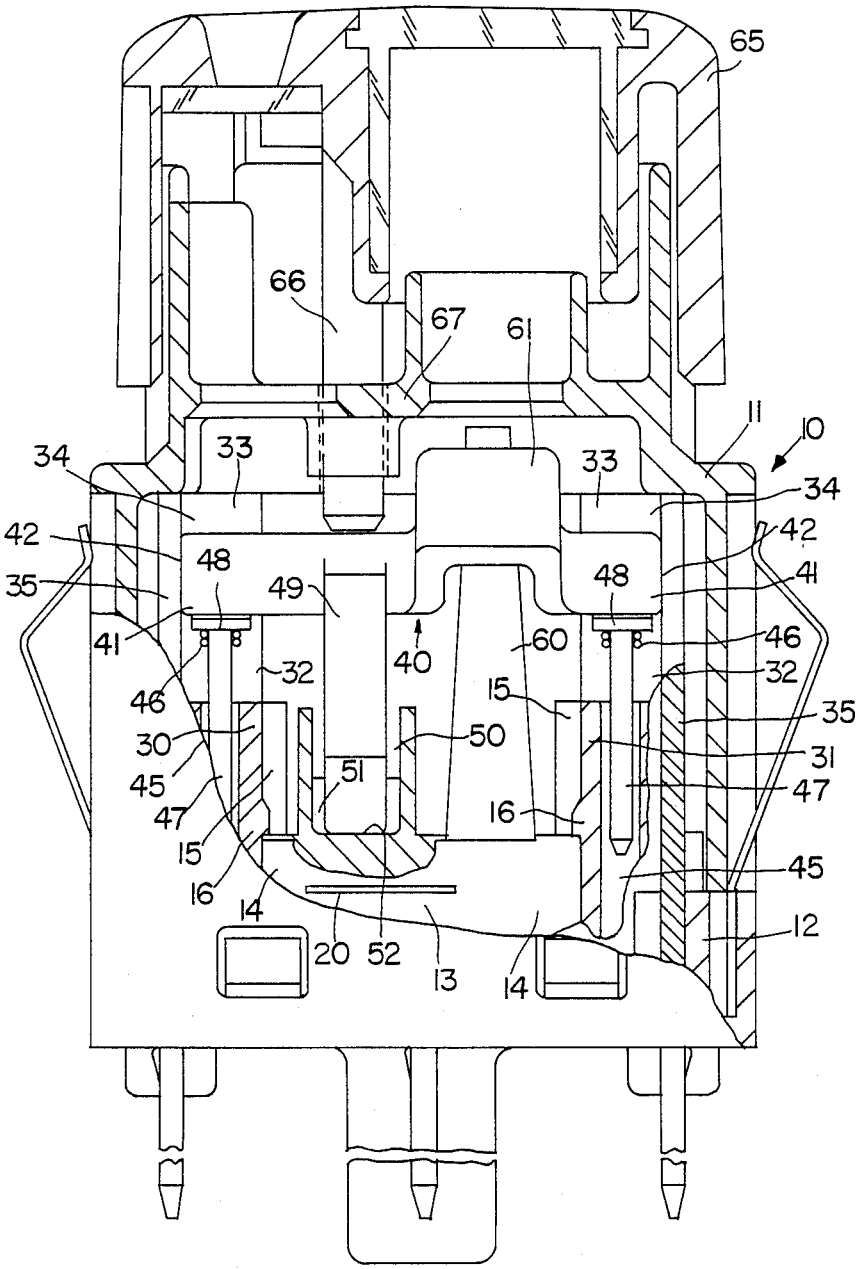
FIG. 2 is a partial sectional view of the electric switch of FIG. 1 in a plane which is perpendicular to the section of FIG. 1.

The housing 10 of the illustrated electric switch consists of a frame 11 and a base plate 12. The base plate 12 is provided with several projecting parts fulfilling bearing and supporting functions. A switching rocker 13 is swivellably mounted on plate 12 by means of two pivot pins 14. By these pivot pins 14, the switching rocker 13 is inserted into two grooves 15 to such an extent that the pivot pins 14 engage a latch projection 16 each at the bottom of the grooves and are thus safely locked in the grooves 15.

One end of a leaf spring 20 is clamped as a snap-action spring into a switching rocker 13 and the other end is supported in a notch of a metal sheet 21. The distance between the bearing axis of the switching rocker 13 and the metal sheet 21 and the length of the leaf spring 20 are coordinated in such a way that the leaf spring is bent and holds the switching rocker 13 in the end position reached after being switched over. A movable contact stud 22 with a contact bead 23 is integrally formed with the snap-action spring 20 which contact bead cooperates in turn with two stationary contacts 24 and 25 held on the base plate 12.

Columns 30 and 31 project from the base plate and are provided with grooves 15. An elongated hole 32, which projects through a wall of the base plate 12 is provided above each groove 15, the longitudinal direction of which elongated hole is identical with the longitudinal direction of the grooves 15 and opens on top toward the outside by means of an inserting slot 34 provided with an inserting inclination 33. The width of the inserting slot 34 is smaller than the width of the respective elongated hole 32. Furthermore, the elongated holes 32 penetrate the columns 30 and 31 at their total width so that the two columns have the shape of clothes-pins in the area of the elongated holes 32. However, the two elongated holes 32 are closed by a metal sheet protruding from the base plate 12 toward the outside in the direction of the frame 11 penetrating said base plate and forming a blade terminal 35 at the outside.

A switching tappet 40 acts upon the elongated holes 32 by two pins 41, the diameter of which is the same as the width of the elongated holes 32, and is mounted in such a way that it can be moved longitudinally of the elongated holes 32, but it can simultaneously also be swivelled around. While swivelling around the switching tappet 41 swivelling axis of said swivelling tappet is formed by the axis of the pin 41 so that it is stationary with respect to the switching tappet 40. For mounting the switching tappet 40, the pins 41 are pressed through the inserting slots 34 into the elongated holes 32. The inserting slots 34 are thereby widened. Afterwards, the pins 41 and thus the switching tappet 40 are safely locked in the elongated holes 32 and thus also on the base plate because the width of the inserting slots 34 is smaller than the diameter of the pin 41. The distance of front faces 42 of the two pins is more or less the same as the distance of the side areas of the metal sheet 35 facing each other so that the switching tappet 40 has only minimal play in the direction of the axis of the pin 41.

On the side opposite the inserting slot 34 there is a bore 45 in every elongated hole 32 and a compression spring 46 is placed therein. Inside each compression spring 46 there is a spike 47 which together with a plate 4B is located between the compression spring and the pin 41. In the rest position of the switching tappet 40 as illustrated in the figures, the compression springs 46 push the pins 41 onto the top end of the elongated holes 32. In this state the spikes 47 are at a distance from the bottom of the bores 45 so that they do not prevent the switching tappet 40 from moving downwardly.

The one pivot pin of the switching tappet 40 substantially extends from the elongated hole 32 toward the inside, where a finger 49 is formed onto it. The finger 49 extends into a projection 50 of the switching rocker 13 open toward the switching tappet 40, which switching rocker is provided with two stops 51 in the swivelling direction of the switching tappet 40 and the bottom 52 of which is formed in a gable roof-type shape. In addition to the projection 50, the switching rocker 13 includes a resilient web 60 that extends beyond the axis of the pivot pin 41 of the switching tappet 40. Inside a gap 61—from the point of view of the swivelling axis of the switching rocker 13—the web 60 acts upon the switching tappet 40 beyond the axis of the pivot pin 41. As can be seen clearly in FIG. 1, the web 60 always swivels about the switching tappet 40 in such a way that said switching tappet touches the stop 51 of the projection 50 of the switching rocker 13 in an end position of the switching rocker 13.

On the frame 11 of the housing 10 a push-button 65 is movably guided in linear direction in a limited manner. Compression springs (not illustrated in the figures) make sure that the push-button returns into the position shown in the figures after being actuated. A pin 66 is formed on the push-button 65, which pin projects through an intermediate cover 67 of the frame 11 in the rest position of the push-button 65 and of the switching tappet 40 up to said switching tappet. Above the finger 49 it can actuate the switching tappet 40 on the outer circumference of the one pivot pin 41 largely extending inside. Thus, a force exerted by the push-button is directly transmitted via the pin 6 and the finger 49 of the switching tappet 40 without any breakdown torques.

In operation, starting from the position shown in the figures, if the push-button 65 is pressed, the switching tappet 40 is carried along via the pin 66. The finger 49 of the switching tappet remains at the stop 51 of the projection 50 of the switching rocker 13 and swivels the switching rocker—according to FIG. 1—clockwise. The snap-action spring 20 is bent in the shape of an S until its dead point is overcome and then all of a sudden, changes the switching rocker 13 into its other end position. Then, if the push-button is relaxed the switching tappet 40 together with its pivot pin 41 returns to the top end of the elongated holes 32 and is thereby swivelled clockwise around by the web 60 of the switching rocker 13 until it touches the other stop 51 of the projection 50 of the switching rocker 13.

Since the electric switch illustrated in the figures and in accordance with the invention has the switching rocker 13 and the switching tappet 40 mounted on the base plate, the switching mechanism can be actuated, when these parts are initially fixed onto the base plate 12. The frame 11 and the push-button 65 need not be assembled with the base plate 12. Thus the switching mechanism can easily be checked as by visual inspection and possible mistakes can easily be corrected.

What has been taught, then, is an electric switch apparatus of improved design which overcomes the disadvantages of the prior art. It will be appreciated by those skilled in the art that the present invention provides advantages in operation and maintenance heretofore deemed unattainable. The form of the invention illustrated and described herein is but a preferred embodiment of these teachings. It is shown as an illustration of the inventive concepts, however, rather than by way of limitation, and it is pointed out that various modifications and alterations nay be indulged in within the scope of the appended claims.

What is claimed is:

1. An electric switch having a housing including a base plate, said switch comprising a push-button which is movable in a linear direction with respect to the housing, a switching tappet movable by means of the push-button and swivellable with respect to said push-button and a switching rocker which is rotatably mounted on the base plate, the switching rocker being movable between two end positions via the push-button and the switching tappet and which thereby controls a movable bridging contact, and said switching tappet being mounted on the base plate, wherein the switching tappet is mounted to said base plate by means of at least one pivot pin, and at least one elongated hole, wherein the switching tappet is affixed to the base plate, and wherein said at least one elongated hole has an inserting slot provided with an inserting inclination, the width of which inserting slot is smaller than the diameter of said at least one pivot pin.

2. An electric switch having a housing including a base plate, said switch comprising a push-button which is movable in a linear direction with respect to the housing, a switching tappet movable by means of the push-button and swivellable with respect to said push-button and a switching rocker which is rotatably mounted on the base plate, the switching rocker being movable between two end positions via the push-button and the switching tappet and which thereby controls a movable bridging contact, and said switching tappet being mounted on the base plate, wherein the switching tappet is mounted by means of at least one pivot pin, and at least one elongated hole; and, wherein said at least one elongated hole projects through a wall of the base plate in perpendicular direction to the motion plane of the switching tappet and a metallic member affixed to one of the base plate or a frame of a housing closes said at least one elongate hole on the side away from the switching tappet.

3. An electric switch having a housing including a base plate, said switch comprising a push-button which is movable in a linear direction with respect to the housing, a switching tappet movable by means of the push button and swivellable with respect to said push-button and a switching rocker which is rotatably mounted on the base plate, the switching rocker being movable between two end positions via the push-button and the switching tappet and which thereby controls a movable bridging contact, and said switching tappet being mounted on the base plate; and wherein the switching rocker determines the rest position of the switching tappet with regard to the tappets swivelling position via a resilient web integrally extending from the switching rocker, said web acting upon the switching tappet relative to a swivelling axis of said switching rocker at the position beyond the swivelling axis of the switching tappet.

4. An electric switch having a housing including a base plate, said switch comprising a push-button which is movable in a linear direction with respect to the housing a switching tappet movable by means of the push-button and swivellable with respect to said push-button and a switching rocker which is rotatably mounted on the base plate, the switching rocker being movable between two end positions via the push-button and the switching tappet and which thereby controls a movable bridging contact, and said switching tappet being mounted on the base plate, wherein the switching tappet is mounted to said base plate by means of at least one pivot pin, and at least one elongated hole, and, wherein a compression spring is supported on each pivot pin of the switching tappet.

5. An electric switch according to claim 4, wherein the compression spring is guided in a bore located in the base plate, where bore hole is located in a portion of said at least one elongated hole and opens toward said at least one elongated hole, and touches the said at least one pivot pin of the switching tappet inside said at least one elongated hole.

6. An electric switch according to wherein a spike is positioned inside the compression spring said spike together with a plate being positioned between the compression spring and the pivot pin.

* * * * *